US007465127B1

(12) United States Patent
Kipp

(10) Patent No.: US 7,465,127 B1
(45) Date of Patent: Dec. 16, 2008

(54) METHOD FOR POSITIVE LOCKING OF TENDON BOTTOM CONNECTORS

(75) Inventor: Robert M. Kipp, Fulshear, TX (US)

(73) Assignee: Sea Engineering, Inc., Houston, TX (US)

( * ) Notice: Subject to any disclaimer, the term of this patent is extended or adjusted under 35 U.S.C. 154(b) by 111 days.

(21) Appl. No.: 11/705,935

(22) Filed: Feb. 13, 2007

Related U.S. Application Data

(60) Provisional application No. 60/772,726, filed on Feb. 13, 2006.

(51) Int. Cl.
*E02D 31/06* (2006.01)

(52) U.S. Cl. ..... 405/224

(58) Field of Classification Search ..... 405/223.1, 405/224; 403/40
See application file for complete search history.

(56) References Cited

U.S. PATENT DOCUMENTS 4,611,953 A 9/1986 Owens
4,848,970 A 7/1989 Hunter et al.
4,907,914 A 3/1990 Gunderson et al.
4,943,188 A 7/1990 Peppel
5,004,272 A 4/1991 Kipp
5,324,141 A 6/1994 Hunter et al.
5,480,521 A * 1/1996 Snyder et al. ..... 405/195.1
6,568,875 B1 5/2003 Paulshus et al.
RE38,458 E 3/2004 Pallini, Jr. et al.
2002/0096878 A1* 7/2002 DeBerry et al. ..... 285/123.4
2003/0145995 A1* 8/2003 Andersen et al. ..... 166/345

* cited by examiner

*Primary Examiner*—John Kreck
(74) *Attorney, Agent, or Firm*—Kenneth A. Roddy

(57) ABSTRACT

A method for positive locking of a tension leg platform tendon bottom connector C in a tendon receptacle R contained in a tendon foundation pile P, the bottom connector and receptacle having mating locking elements. A vertical space S is provided in the foundation pile between the tendon receptacle and the soil level inside the pile sufficient to allow vertical entry and locking of the bottom connector and receptacle locking elements, and a material M of sufficient density is placed into the space beneath the tendon bottom connector in the tendon receptacle and the soil level inside the pile to limit downward vertical motion of the bottom connector and prevent accidental release of the locking elements. When required, a sufficient amount of the material may be removed to allow the requisite vertical motion of the bottom connector to release the locking elements.

13 Claims, 1 Drawing Sheet

METHOD FOR POSITIVE LOCKING OF TENDON BOTTOM CONNECTORS

CROSS REFERENCE TO RELATED APPLICATION

This application claims priority of U.S. Provisional Patent Application Ser. No. 60/772,726, filed Feb. 13, 2006.

BACKGROUND OF THE INVENTION

1. Field of the Invention

This invention relates generally to bottom connectors for tension leg platform tendons, and more particularly to a method for positive locking of a tension leg platform tendon bottom connector in a receptacle.

2. Background Art

The bottom connectors typically used on the tendons of tension leg platforms (TLP) make connection to specially profiled connection sleeves (also known as receptacles) that are incorporated into the upper portion of the tendon foundation piles. It has been common practice to design tendon bottom connectors that are locked and unlocked with the receptacle by means of vertical motion. The typical lock function is for the bottom connector to be inserted into the pile, and locking with the receptacle is achieved by a vertical downstroke, sometimes with an upstroke after the initial downstroke. The typical unlock function is to downstroke the bottom connector with mechanical elements of the bottom connector to cause an unlock condition and release to occur with subsequent upward motion.

Accepted practice has been to design the tension leg platform (TLP) in such a fashion that the expected tendon bottom tension will either stay positive, preventing downstroke and subsequent release activation, or only slightly negative, allowing insufficient downstroke to begin the subsequent release activation.

The following U.S. patents are exemplary of conventional tendon bottom connectors for use with tension leg platforms, all of which are hereby incorporated by reference to the same extent as if fully set forth herein.

Owens, U.S. Pat. No. 4,611,953
Hunter, et al, U.S. Pat. No. 4,848,970
Gunderson, et al, U.S. Pat. No. 4,907,914
Peppel, U.S. Pat. No. 4,943,188
Kipp, U.S. Pat. No. 5,004,272
Hunter, et al, U.S. Pat. No. 5,324,141
Paulshus, et al, U.S. Pat. No. 6,568,875
Pallini, Jr., et al, U.S. Pat. RE 38,458

The patents listed above show and describe various conventional tendon bottom connectors and tendon receptacles having various types of mating latching or locking and release mechanisms. It should be understood that the present invention is directed toward a method for positive locking of a tension leg platform tendon bottom connector in a tendon receptacle contained in a tendon foundation pile, and may be utilized with conventional tendon bottom connectors and receptacles of various construction wherein release of the locking elements is accomplished by vertical motion of the bottom connector. The patents listed above do not disclose the present method for positive locking of the tendon bottom connector as set forth herein. The reader may refer to the above patents for a more comprehensive detailed description of the structural components of tendon bottom connectors, their latching or locking and release components, and their operation.

The present invention is distinguished over the prior art in general by a method for positive locking of a tension leg platform tendon bottom connector in a tendon receptacle contained in a tendon foundation pile, the bottom connector and receptacle having mating locking elements. A vertical space is provided in the foundation pile between the tendon receptacle and the soil level inside the pile sufficient to allow vertical entry and locking of the bottom connector and receptacle locking elements, and a material of sufficient density is placed into the space beneath the tendon bottom connector in the tendon receptacle and the soil level inside the pile to limit downward vertical motion of the bottom connector and prevent accidental release of the locking elements. When required, a sufficient amount of the material may be removed to allow the requisite vertical motion of the bottom connector to release the locking elements.

SUMMARY OF THE INVENTION

It is therefore an object of the present invention to provide a method for positive locking of a tension leg platform tendon bottom connector in a receptacle.

It is another object of this invention to provide a method and means to effectively limit the available downstroke of the bottom connector, thereby increasing the resistance to release of the bottom connector without intentional intervention to allow the required bottom stroke.

Another object of this invention is to provide a method for positive locking of a tension leg platform tendon bottom connector in a tendon receptacle contained in a tendon foundation pile that may be utilized with conventional tendon bottom connectors and receptacles of various construction wherein release of the locking elements is accomplished by vertical motion of the bottom connector.

Another object of this invention is to provides a method for positive locking of a conventional tension leg platform tendon bottom connector in a tendon receptacle contained in a tendon foundation pile which does not require modification of the existing bottom connector or its locking elements.

Other objects of the invention will become apparent from time to time throughout the specification and claims as hereinafter related.

The above noted objects and other objects of the invention are accomplished by a the present method for positive locking of a tension leg platform tendon bottom connector in a tendon receptacle contained in a tendon foundation pile, the bottom connector and receptacle having mating locking elements. A vertical space is provided in the foundation pile between the tendon receptacle and the soil level inside the pile sufficient to allow vertical entry and locking of the bottom connector and receptacle locking elements, and a material of sufficient density is placed into the space beneath the tendon bottom connector in the tendon receptacle and the soil level inside the pile to limit downward vertical motion of the bottom connector and prevent accidental release of the locking elements. When required, a sufficient amount of the material may be removed to allow the requisite vertical motion of the bottom connector to release the locking elements.

DESCRIPTION OF THE PREFERRED EMBODIMENT

Figure 1:
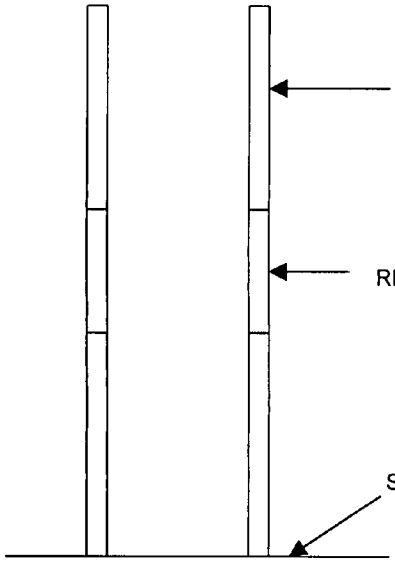
FIGS. 1, 2 and 3 are schematic longitudinal cross sectional views illustrating the steps in carrying out the method for positive locking of a tension leg platform tendon bottom connector in a receptacle.
Figure 2:
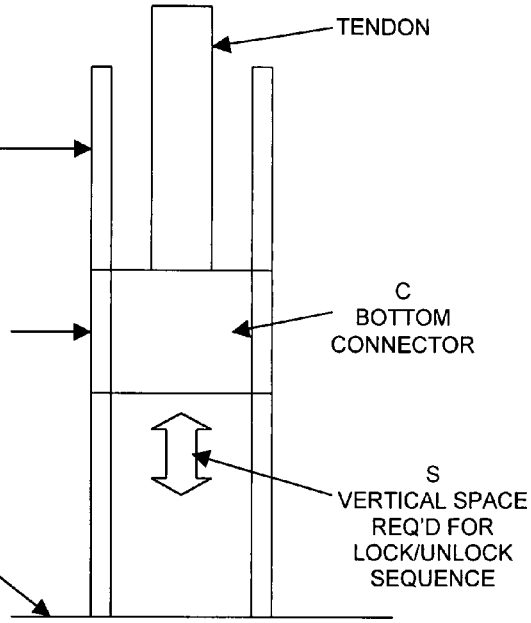
Figure 3:
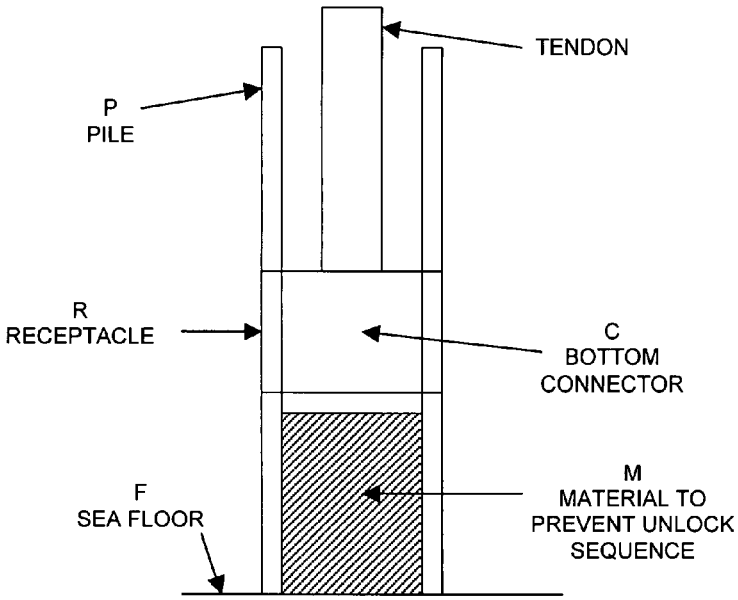

Referring to the drawings by numerals of reference, there is shown schematically in FIGS. 1, 2 and 3, steps in carrying out the present method for positive locking of a tension leg platform tendon bottom connector C in a receptacle R. The present method provides a means to effectively limit the available downstroke of the bottom connector C, thereby increasing the resistance to release of the bottom connector without intentional intervention to allow the required bottom stroke.

The present method may be utilized with conventional tendon bottom connectors and receptacles of various constructions having mating locking elements that are released by vertical motion of the bottom connector. Thus, the tendon bottom connector C, the receptacle R, and the interior components, and mating latching or locking element details are of standard conventional construction and well known in the art and, therefore, are represented schematically and are not shown or described in detail. The reader may refer to the patents listed above for a comprehensive detailed description of bottom connector, receptacle, latching or locking and release components and their operation.

It is common practice to install the tendon foundation piles P so that their top surface is vertically clear of the sea floor F. The tendon receptacle R will also typically be above the sea floor. The receptacle R is high enough so that after installation of the pile P, a vertical space S remains between the receptacle and the soil level inside the pile to allow vertical entry and locking of the bottom connector C. In the (unusual) event that the soil "mud plug" within the pile were to rise significantly above the surround sea level during driving of the pile, practice has been to jet away the surplus elevation of soil within the pile to allow the required vertical motion and activation of the bottom connector. It should be noted that the nature of this soil in terms of mechanical properties is uncertain, and it is likely that this soil is soft and pliable.

In the present method for positive locking of the tendon bottom connector C in the tendon receptacle R, after installation of the pile P, a dense slurry of material M is pumped into the pile top, beneath the bottom connector C to limit downward vertical motion of the bottom connector. One preferred slurry material is a material that is typically used as pumped ballast. For example, the material M may comprise rigid or semi-rigid particles of spherical or other compact shape that are negatively buoyant in sea water. In some installations, if needed, other materials such as lightweight cement may also be pumped into this area prior to introducing the slurry material to form a more stable base for the material.

Key to selection of the injected material(s) M is their ability to withstand the downward force of the bottom connector C, preventing undesired motion and release, in the event that larger than expected negative tendon bottom tensions at the bottom connector were achieved.

The present method preferably makes use of a material that can later be jetted out if desired to allow release of the bottom connector when required.

Many conventional tendon bottom connectors C typically have open spaces between the inner surface of the receptacle R and body of the bottom connector, which allow sufficient space for injection of the filling material M described above. In the event that such space is not available, it is also common in conventional installations to have incorporated multiple small holes near the top of the tendon pile P, and sometimes within the receptacle itself, that are used for discharge of entrapped water within the pile during driving of the pile, and these holes may be used for injection of the filling material. Alternatively, holes or apertures may be formed near the top of the tendon pile P, or within the receptacle itself, to be used for injection of the filling material.

The material M may be jetted out if desired to allow release of the bottom connector when required. For example, nozzles, spray heads or water jets may be placed in the area beneath the bottom connector to remove the slurry material M through the holes or apertures that were used to introduce the material. The slurry material M may also be removed from the area beneath the bottom connector by injection of an air/water mixture through spray heads or water jets to enhance agitation and removal of the slurry material.

The present method of providing a positive lock from disengagement of the bottom connector from the receptacle may be applied either to future installations, or as a retrofit to existing installed tendon bottom connectors.

While this invention has been described fully and completely with special emphasis upon a preferred embodiment, it should be understood that within the scope of the appended claims the invention may be practiced otherwise than as specifically described herein.

The invention claimed is:

1. A method for positive locking of a tension leg platform tendon bottom connector in a tendon receptacle contained in a tendon foundation pile, the bottom connector and receptacle having mating locking elements, said method comprising the steps of:

providing a vertical space in the foundation pile between the tendon receptacle and the soil level inside the pile sufficient to allow vertical entry and locking of the bottom connector and receptacle locking elements; and placing a material of sufficient density into the space beneath the tendon bottom connector in the tendon receptacle and the soil level inside the pile to limit downward vertical motion of the bottom connector and prevent accidental release of the locking elements.

2. The method according to claim 1, wherein said step of providing a vertical space comprises removing sufficient soil within the pile to allow the requisite vertical motion and activation of the locking elements.

3. The method according to claim 1, comprising the further step of:

removing a sufficient amount of the material from the space beneath the tendon bottom connector in the tendon receptacle to allow the requisite vertical motion of the bottom connector to release the locking elements.

4. The method according to claim 1, wherein said step of placing a material comprises pumping a dense slurry of material beneath the bottom connector.

5. The method according to claim 4, wherein said dense slurry of material comprises material used as pumped ballast.

6. The method according to claim 4, wherein said dense slurry of material comprises rigid or semi-rigid particles of compact shape that are negatively buoyant in sea water.

7. The method according to claim 1, wherein said step of placing a material comprises the preliminary step of pumping lightweight cement into the pile to cover the soil level inside the pile and form a stable base; and thereafter pumping a dense slurry of material beneath the tendon bottom connector in the tendon receptacle and the cement covering the soil level inside the pile to limit vertical downward motion of the bottom connector.

8. The method according to claim 1, wherein said step of placing a material beneath said tendon bottom connector comprises pumping a dense slurry of material through an open space between an inner surface of the receptacle and exterior of the bottom connector.

9. The method according to claim 1, wherein said step of placing a material beneath said tendon bottom connector comprises pumping a dense slurry of material through apertures in an upper end of the pile.

10. The method according to claim 1, wherein said step of placing a material beneath said tendon bottom connector comprises pumping a dense slurry of material through apertures in the tendon receptacle.

11. The method according to claim 1, comprising the further step of removing the material from beneath the tendon bottom connector sufficient to allow the requisite vertical motion to unlock the locking elements and release of the bottom connector.

12. The method according to claim 11, wherein said step of removing the material comprises water jetting the materiel from beneath the tendon bottom connector and conducting the material through apertures that were used to introduce the material.

13. The method according to claim 12, wherein said step of water jetting the materiel from beneath said tendon bottom connector includes agitating the material to facilitate its removal.

* * * * *